United States Patent [19]

Kuiken et al.

[11] 4,448,635

[45] May 15, 1984

[54] METHOD OF ETCHING CAVITIES AND APERTURES IN SUBSTRATES AND DEVICE FOR CARRYING OUT SAID METHOD

[75] Inventors: Hendrik K. Kuiken; Rudolf P. Tijburg, both of Eindhoven, Netherlands

[73] Assignee: U.S. Philips Corporation, New York, N.Y.

[21] Appl. No.: 463,761

[22] Filed: Feb. 4, 1983

[30] Foreign Application Priority Data

Nov. 8, 1982 [NL] Netherlands ..... 8204307

[51] Int. Cl.[3] ..... H01L 21/306; C23F 1/02; B44C 1/22; C03C 15/00

[52] U.S. Cl. ..... 156/637; 156/345; 156/644; 156/659.1; 156/647; 156/664

[58] Field of Search ..... 156/345, 646, 637, 638, 156/639, 640, 641, 644, 654, 662, 664, 647, 659.1

[56] References Cited

U.S. PATENT DOCUMENTS

| | | | |
|---|---|---|---|
| 2,867,929 | 1/1959 | Monahan | 156/644 X |
| 2,869,266 | 1/1959 | Hirdler | 156/639 |
| 3,383,255 | 5/1968 | Rossi et al. | 156/345 X |
| 3,730,799 | 5/1973 | Scannell | 156/639 |
| 4,137,118 | 1/1979 | Brimm | 156/639 X |

FOREIGN PATENT DOCUMENTS

| | | | |
|---|---|---|---|
| 143333 | 8/1980 | Fed. Rep. of Germany | 156/639 |

*Primary Examiner*—William A. Powell
*Attorney, Agent, or Firm*—Norman N. Spain

[57] ABSTRACT

Deep cavities and apertures can be obtained with little undercutting (great etching factor) by etching in an artificial gravitational field (under the influence of centrifugal or centripetal forces).

6 Claims, 8 Drawing Figures

METHOD OF ETCHING CAVITIES AND APERTURES IN SUBSTRATES AND DEVICE FOR CARRYING OUT SAID METHOD

The invention relates to a method of etching cavities and apertures in substrates by means of an etchant. The etchant may be liquid or gaseous.

In etching processes the etching rate is usually limited by the speed at which the products formed during etching can be removed from the surface which is etched. Various methods are known to increase the etching rate. A common characteristic feature of several of these methods is that the etchant is forced to flow along the surface to be etched. If, however, the object of the etching treatment is to etch cavities and apertures of small diameters, the etchant cannot or hardly penetrate into a cavity once it has been formed. Under the influence of the etchant flowing along the surface, eddies are formed in the cavity, the axis of rotation of which is approximately parallel to the surface to be etched and is directed approximately perpendicularly to the flow of etchant. The exchange of the products formed during etching and the fresh etchant can now take place only by diffusion from eddy to eddy—if two or more eddies are present in the cavity one on top of the other—and from eddy to the etchant flowing past the surface. The deeper the cavity, the greater the possibility of the formation of two or more eddies one over the other. It has been found in practice that the etching rate in each formation of a new eddy decreases drastically while undercutting increases considerably. It is even doubtful whether in this manner a cavity which has a significantly larger depth than its diameter can be obtained by etching. This also applies if the etching process for the removal of etching products depends exclusively on diffusion, for example, in an etching bath which does not move relative to the surface to be etched.

It is the object of the invention to provide an etching method in which the disadvantages of the described etching methods are avoided. According to the invention, this object is achieved by means of a method which is characterized in that etching takes place in an artificial gravitational field.

An artificial gravitational field is to be understood to mean herein a field of forces as it can be generated in a rotating system (centrifugal forces and centripetal forces).

The method according to the invention is based on the recognition of the fact that in an etching process the density of the etchant changes during etching. The following cases may be distinguished:

1. The products formed during etching increase the density of the etchant, no gas bubbles are formed during etching and deep cavities must be etched with little undercutting (great etching factor). In the method according to the invention the substrate to be etched is arranged in the etchant relative to the artificial gravitational field in such manner that the substrate surface experiences a force which is directed away from the substrate. The etching products formed at the wall of the cavity are now forced out of the cavity.

2. The products formed during etching increase the density of the etchant and the requirement is that the etched cavity has a flat bottom. In the method according to the invention the substrate to be etched is arranged relative to the artificial gravitational field in such manner that the substrate surface experiences a force which is directed towards the substrate. Any gas bubbles formed at the wall of the cavity and which in many cases do not detach therefrom spontaneously and consequently may result in a rough bottom of the cavity are forced out of the cavity in this embodiment of the method according to the invention. A certain extent of undercutting occurs (etching factor smaller than in case 1).

3. The products formed during etching increase the density of the etchant, gas bubbles are formed, the bottom of the cavity may be rough and need not be flat (for example, etching is carried out through the substrate), the cavity to be etched is comparatively deep with little undercutting (great etching factor). The substrate is arranged in the artificial gravitation field as in case 1, which means that it experiences a force which is directed away from the substrate surface. If a cavity is etched, it has a rough bottom in that the gas bubbles impede a uniform action of the etchant.

4. The products formed during etching decrease the density of the etchant, no gas bubbles are formed, cavities of great depth and little undercutting (great etching factor) have to be formed. The substrate is arranged in the artificial gravitational field in such manner that the substrate surface experiences a force which is directed towards the surface. The etching products formed are forced out of the cavity.

5. The products formed during etching reduce the density of the etchant, gas bubbles are formed. Cavities of comparatively great depth are required with little undercutting (great etching factor). The substrate is arranged in the artificial gravitational field in such manner that the substrate surface experiences a force which is directed towards the surface, i.e. as in case 4.

6. The products formed during etching reduce the density of the etchant, gas bubbles are formed, cavities with flat bottom are required, undercutting is acceptable (smaller etching factor than in case 4). The substrate is arranged in the artificial gravitational field in such manner that the substrate surface experiences a force which is directed away from the surface. Gas bubbles, however, remain on the bottom, a rough, flat bottom is formed.

By choosing the etchant with a view to the possible formation of gas bubbles and etching products which increase or decrease the density of the etchant, any desired cavity having a trough-like or flat bottom, rough or not rough, can be obtained.

The method can be carried out in a device in which the etching bath is present in a vessel which is movably connected to a rotatable shaft which can be rotated at high speed by means of a driving mechanism. An example of a suitable embodiment is a hollow cylinder which can rotate about the cylinder axis at high speed. Holders for the articles to be etched may be present in the cylinder. These articles, for example, may be plates. Dependent, for example, on the fact whether the density of the etchant increases or decreases during etching, the plates are arranged in the holders with the surface to be etched facing or remote from the cylinder.

It has been found that the correct acceleration of the artificial gravitational field for optimum etching of a cavity with given dimensions i.e. with extreme avoidance of undercutting is given by the following formula $$a = a_r\left(\frac{l_r}{l}\right)^3$$

wherein 1 is the given diameter of the cavity and a is the acceleration in the artificial gravitational field. $a_r$ and $l_r$ are determined as follows. A bare substrate of the same composition as the substrate to be etched is etched in an artificial gravitational field until a slight etching has been obtained. The substrate is arranged in the field as is necessary to cause the etched products to leave a cavity (see above). A pattern of cells is reproduced on the substrate during etching (Bénard cells). The average diameter of the cells is assumed to be equal to $l_r$ the acceleration in the field used is $a_r$ (see for the phenomenon Bénard cells: S. Chandrasekhar "Hydrodynamic and Hydromagnetic Stability" Oxford at the Clarendon Press reprint 1968, pp. 9 and 10 and 43).

The method according to the invention will now be described in greater detail with reference to the accompanying drawing and a number of examples.

Figure 1A:
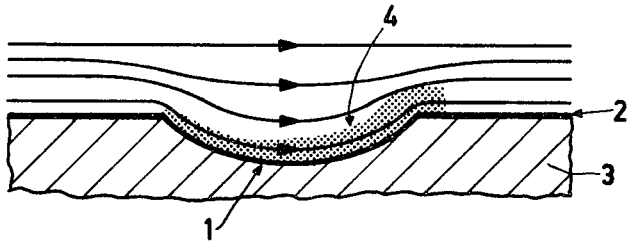
FIGS. 1A to 1C show on an enlarged scale the formation of an eddy or eddies in a cavity.

FIG. 1A is a diagrammatic cross-sectional view of the flow profile in a liquid etchant as it may occur at a given moment, for example, in the so-called spray-etching, in a shallow cavity 1 in a substrate 3 covered by means of an etching mask 2. The etching products 4 formed (shown dotted) are taken along by the past-flowing etching liquid. As long as this situation exists, etching, for example, in spray-etching, occurs rather rapidly. However, when the depth of the cavity 1 increases, eddies 5 will form in the cavity 1 as is shown diagrammatically in the cross-sectional view of FIG. 1B. The etching products 4 (shown dotted) formed at the wall of the cavity 1 are taken along only for a small part by the past-flowing etchant but for the greater part they can disappear from the cavity 1 (FIG. 1B) only by diffusion. Consequently the etching rate decreases considerably. The etching rate is largest at the edges of the cavity 1 so that a strong undercutting starts to occur. The etching rate is lowest at the bottom of the cavity. When the depth of the cavity 1 still increases the FIG. 1C situation might occur in which two (5 and 6) or possibly more eddies are formed one over the other. In the FIG. 1C situation the etching products which are formed on the bottom of the cavity can leave such cavity only slowly.

Figure 2:
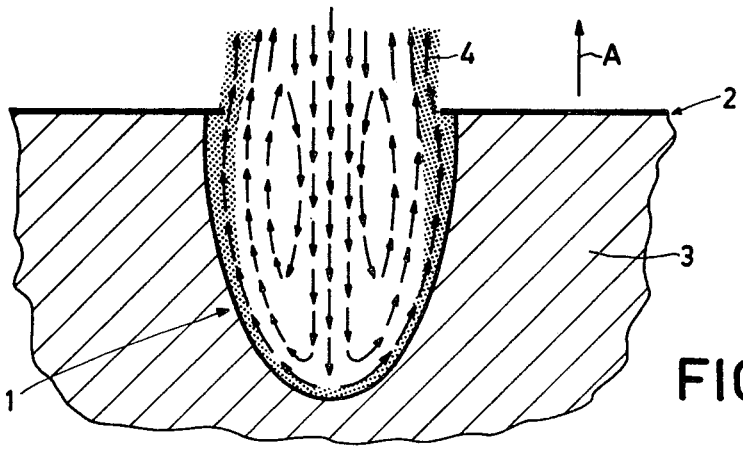
FIG. 2 shows on an enlarged scale the flow in a cavity in a method according to the invention. (cases 1 and 3)

FIG. 2 shows the situation in the method according to the invention. The arrow indicated by A denotes the direction of the acceleration in the artificial gravitational field. (as in cases 1 and 3)

Figure 1B:
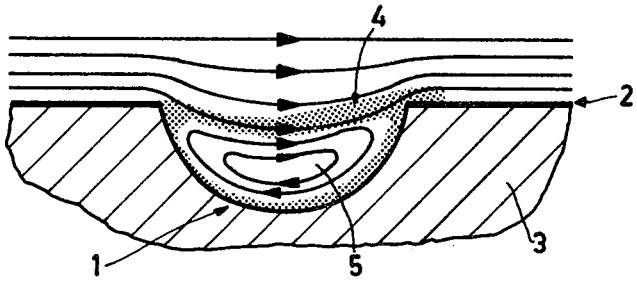
Figure 1C:
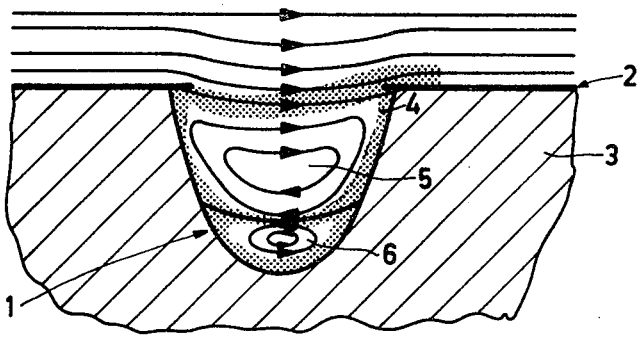

Same reference numerals in FIGS. 1A to 1C have the same meaning. FIG. 2 relates to a situation in which the density of the etching liquid in the proximity of the wall of the cavity 1 increases during etching. Under the influence of the artificial gravitational field the comparatively heavier liquid which is enriched in etching products 4 is drawn out of the cavity. The small arrows in this and preceding Figures indicate the flow in the etching liquid.

Figure 3A:
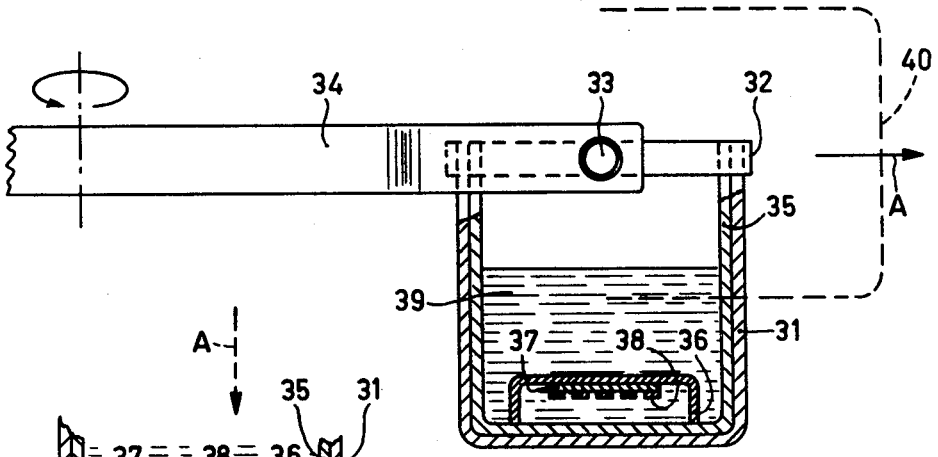
FIGS. 3A to 3C show an experimental device for etching in an artificial gravitational field.
Figure 3C:
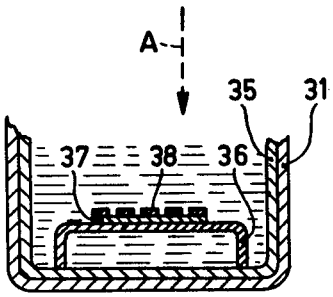
Figure 3B:
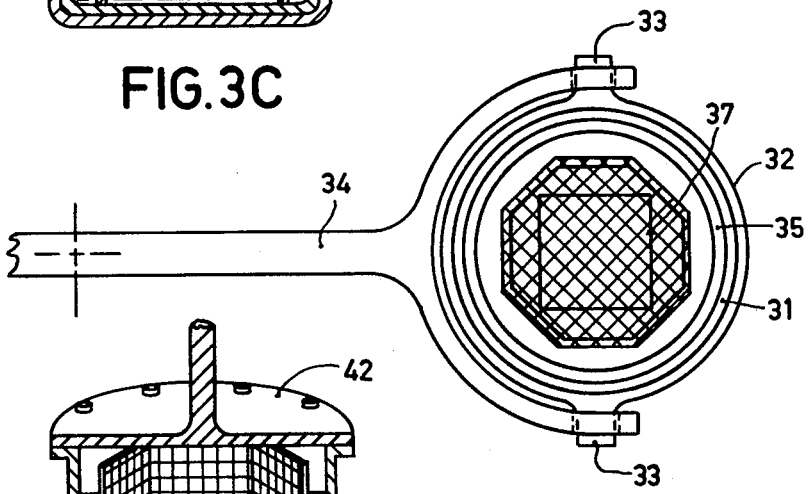

FIGS. 3A to 3C are diagrammatic cross-sectional views in side elevation (3A and 3C) and in plan view (3B), respectively, of an experimental device for etching with an etching liquid under the influence of an artificial gravitational field. An outer vessel 31, for example of stainless steel, which via a clamping in the form of a ring 32 having pins 33 is movably suspended in an arm 34 can be rotated at high speed about an axis (not shown). During operation, an inner vessel 35 of etchant-resistant material, for example, of polytetrafluoroethylene, is placed in the outer vessel 31. A holder 36 on which a substrate 37 to be etched is connected is present on the bottom of the inner vessel. An apertured etchant-resistant mask 38 is present on the substrate 37. The vessel 35 furthermore comprises an etchant 39. When the vessel 32 is rotated at high speed it assumes the position which is indicated in broken lines 40 (FIG. 3A). The etchant 39 experiences an outwardly directed force (arrow A). The arrangement shown relates to a situation in which upon forming etching products the density of the etching liquid increases at the wall of the apertures to be etched. Under the influence of the artificial gravitational field, etching products are removed from the apertures and cavities and are replaced by fresh etching liquid. A number of experiments was carried out in a device as is shown diagrammatically in FIGS. 3A–3C. The vessel 35 had a capacity of 250 ml. The maximum speed of rotation was 30 rps. This provides an acceleration of the artificial gravitational field of 500 g at the location in the vessel where the samples to be etched are arranged. The samples were placed on top of (FIG. 3C) or below (FIG. 3A) a glass holder 36. The former case will hereinafter be referred to as a positive acceleration of the gravity and the second cases a negative acceleration.

EXAMPLE 1

Slices of monocrystalline (100) oriented n-type GaAs having a thickness of 200 μm were etched. For that purpose, the slices were provided with a layer of $SiO_2$ obtained by pyrolysis in the form of a pattern having circular apertures with diameters ranging from 80 μm to 5000 μm.

The slices were etched either with an etchant which has a preference for certain crystallographic directions in the crystal (A) or an etchant which etches at random (B).

The etchant A consisted of:

3 parts by volume of $CH_3OH$ (methanol)

1 part by volume of $H_3PO_4$ (concentrated solution in water; d=1.71)

1 part by volume of $H_2O_2$ (30% by weight in water; d=1.1)

This etchant has the lowest etching rate on a (1,1,1) surface.

The etchant B consisted of:

5 parts by volume of $H_3PO_4$ (concentrated solution in water; d=1.84)

5 parts by volume of $H_2SO_4$ (concentrated solution in water)

2 parts by volume of $H_2O_2$ (30% by weight in water; d=1.1).

At the beginning of an experiment the temperature of the etchant was always 20° C.

The results of a number of experiments are recorded in Table 1. The apertures had diameters which were larger than the etching depth.

TABLE 1

Figure 4:
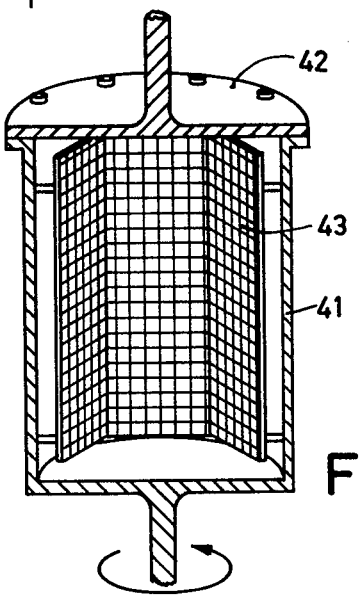
FIG. 4 shows a practical embodiment of a device for etching in an artificial gravitational field.

| Etching time: 6 minutes | Etching depth in GaAs Etchant A | Etchant B |
|---|---|---|
| Etching depth without artificial gravitational field | 11 μm | 6 μm |
| Etching depth with +350 g (directed towards the surface to be etched) see FIG. 4 | 25 μm | 25 μm |
| Etching depth with −350 g (directed away from the surface to be etched) see FIG. 2 and 3 | 50 μm | 55 μm |

Although in both cases (positive acceleration and negative acceleration) an increase of the etching rate is obtained in the artificial gravitational field, the increase appears to be largest if the direction of the field is directed away from the surface to be etched (FIG. 3A). This latter indicates that upon etching the density of the etching liquid increases. In the former case, direction of the field directed towards the surface to be etched (FIG. 3C), much more undercutting occurred moreover than in the other case.

EXAMPLE 2

A foil having a thickness of 400 μm of phosphorus bronze (composition 92% by weight of Cu, 7.6% by weight of Sn, 0.4% by weight P) was etched with an aqueous $FeCl_3$−solution having a density of 1.39 under the influence of artificial gravitational fields with acceleration from +500 g to −25000 g.

The etching resist consisted of a layer of lacquer capable of withstanding the etchant. The apertures in the etching resist had diameters ranging from 100 to 5000 μm.

In the case in which the gravitational field was directed towards the surface to be etched (FIG. 3C) the etched cavities had perpendicular walls and a flat bottom. However, undercutting was approximately half of the etched depth of the cavity with etching times up to 15 minutes (etching factor (=2) with longer etching times the undercutting becomes approximately equal to the etching depth (etching factor =1).

The results of a number of experiments are recorded in Table 2.

TABLE 2

| Acceleration gravitational field | Etching depth in phosphorus bronze (foil thickness 400 μm) etching time 7.5 min. | 15 min. | 60 min. |
|---|---|---|---|
| 1 g (without the use of an artificial field) | | 20 μm | |
| −140 g | | 100 μm | 100–300 μm |
| −350 g | 50 μm | 100 μm | 120–400 μm |
| −500 g | | 125 μm | 160–400 μm |
| −25000 g(x) | | 200–400 μm | |

(x)not in the FIG. 3 arrangement, but in an ultracentrifuge.

In case one value is recorded in the Table it relates to a cavity having a diameter of 100 μm, in case two values are recorded the second value relates to a cavity having a diameter of 5000 μm. In case the second value is 400 μm, the foil was etched through, this is not the etching depth which could have been reached with a foil thickness exceeding 400 μm.

The average etching rate with a given etching time at −350 g for various hole diameters is recorded in Table 3. The etching rate in a stationary etching bath is approximately 1 μm/minute for hole diameters ≧100 μm.

TABLE 3

| Gravitational field −350 g. etching time in min. | Average etching rate per minute/in μm/min. Initial diameter hole in μm 100 | 250 | 500 | 5000 |
|---|---|---|---|---|
| 7.5 | 8 | 6 | 7 | 17 |
| 30 | 2 | 3.5 | 3.5 | 13 |
| 60 | 2 | 3.5 | 3.5 | 7 |
| 90 | 2 | 3.5 | 3.5 | 4.5 |

In an ultracentrifuge (−25000 g) the etching rate was more than 40 μm/min with a hole diameter of 250 μm and 13 μm/min with a hole diameter of 100 μm, in both cases with an etching time of 15 min.

In these experiments, undercutting proved to be substantially independent of the hole diameter, the etching time and the acceleration of the artificial gravitational field. Undercutting was in the order of 0.1 of the etching depth (etching factor=10).

FIG. 4 shows diagrammatically a part of a practical embodiment for a device. The device comprises a closable vessel 41 having a lid 42 with which the vessel can be sealed in a liquid-tight manner. A holder 43, for example of a gauze of a metal which can withstand the etchant, is present in the vessel 41, the substrate to be etched can be provided by means of clamping members onto the gauze. The holder may comprise a number of surfaces, for example six, for connecting flat substrates.

The vessel is rotated by means of a driving device not shown. After providing the articles to be etched, the vessel, while stationary, can be filled with etchant to above the holder 43. In the method according to the invention etching is carried out essentially in a stationary etching bath. Under the influence of the artificial gravitational field, a local flow is caused during etching only in the cavities and apertures in the articles, as a result of density differences which occur in the etching liquid. These local flows ensure that etching products which, in case of prolonged stay in the cavities, would reduce the etching rate are removed out of the cavities and apertures.

What is claimed is:

1. A method of etching cavities and apertures in a substrate comprising subjecting said substrate to the action of an etchant characterized in that the etching takes place in an artificial gravitational field causing a relative movement of the etchant in regard to the substrate solely by virtue of the difference of the density between the etchant and the products formed during etching.

2. An etching method as claimed in claim 1, characterized in that the substrate to be etched is arranged relative to the artificial gravitational field in such manner that it experiences a force which is directed away from the surface in the case in which the formed etching products increase the density of the etchant.

3. An etching method as claimed in claim 1, characterized in that the substrate to be etched is arranged relative to the artificial gravitational field in such manner that it experiences a force which is directed towards the surface in the case in which the formed etching products increase the density of the etchant.

4. An etching method as claimed in claim 1, characterized in that the substrate to be etched is arranged relative to the artificial gravitational field in such manner that it experiences a force which is perpendicular to and is directed towards the surface in the case in which the formed etching products decrease the density of the etchant.

5. An etching method as claimed in claim 1, characterized in that the substrate to be etched is arranged relative to the artificial gravitational field in such manner that it experiences a force which is directed away from the surface in the case in which the formed etching products decrease the density of the etchant.

6. A method as claimed in claim 1, characterized in that the acceleration of the gravitational field used is chosen to be so that $$a = a_r\left(\frac{l_r}{l}\right)^3$$

wherein a and $a_r$ are the acceleration to be used and the acceleration in a blank experiment, respectively, and 1 and $l_r$ are the diameter of the cavity to be etched and the diameter of a Bénard cell in the blank experiment, respectively.

* * * * *

UNITED STATES PATENT AND TRADEMARK OFFICE

CERTIFICATE OF CORRECTION

PATENT NO. : 4,448,635

DATED : May 15, 1984

INVENTOR(S) : Hendrik K. Kuiken; Rudolf P. Tijburg

It is certified that error appears in the above-identified patent and that said Letters Patent is hereby corrected as shown below:

Column 3, line 62 change "Same" to --The same--

Column 4, line 8, change "via" to --by means of -- line 9, change "in" to --on--, insert --and-- after "34"
line 11, insert --the-- after "During", Column 5, in table 1, line 11 after "to be etched) see FIG." change "4" to --3 C--
line 14 after "see FIG. 2 and" change to --3A--

Signed and Sealed this

*Fifth* Day of *November 1985*

[SEAL]

*Attest:*

DONALD J. QUIGG

*Attesting Officer*

*Commissioner of Patents and Trademarks*